United States Patent [19]

Doyle et al.

[11] 4,341,385

[45] Jul. 27, 1982

[54] ELECTRONIC BOARD GAME APPARATUS

[76] Inventors: Holly T. Doyle; Robert O. Doyle, both of 77 Huron Ave., Cambridge, Mass. 02138; Wendl Thomis, 383 Old Beaver Brook Rd., Acton, Mass. 01718

[21] Appl. No.: 114,905

[22] Filed: Jan. 24, 1980

[51] Int. Cl.[3] ..... A63F 3/00

[52] U.S. Cl. ..... 273/237; 273/1 E; 273/138 A

[58] Field of Search ..... 273/237, 1 E, 85 G, 273/238, 265, 138 A

[56] References Cited

U.S. PATENT DOCUMENTS

| | | | |
|---|---|---|---|
| 3,179,414 | 4/1965 | Mertz et al. | 273/265 X |
| 3,367,653 | 2/1968 | Brown | 273/1 E |
| 3,711,101 | 1/1973 | Breslow et al. | 273/238 |
| 4,017,072 | 4/1977 | Kurtz | 273/237 X |
| 4,017,081 | 4/1977 | Windisch | 273/237 X |
| 4,171,135 | 10/1979 | Doyle et al. | 273/237 |
| 4,231,577 | 11/1980 | Thomas et al. | 273/238 |

*Primary Examiner*—William H. Grieb
*Attorney, Agent, or Firm*—Kenway & Jenney

[57] ABSTRACT

In the game disclosed herein, participants move their tokens, each representing a detective, over an indicia-carrying game board in pursuit of an imaginary thief whose location is not apparent on the board. The indicia on the board defines a multiplicity of locations of several types and possible paths of movement between locations in accordance with certain rules of the game. A value representing the location of the imaginary thief is held in a memory or storage register within a digital computing apparatus. The digital computing apparatus also includes a fixed table of information representing the various playing field locations, together with data representing the character of each location. The value representing the location of the thief is periodically changed, upon player initiation, in a manner determined by a random number generator but in a conformance with predetermined rules of movement. The digital computing apparatus also drives sound generating means to produce one of a plurality of characteristic sounds following each of the thief's moves. Each characteristic sound is associated with a particular type of location on the playing field so that the sounds constitute clues as to the thief's movement and location. The digital computing apparatus includes also a player operable means for initiating a capture and for designating a playing field location at which the capture is to take place. The processor determines whether the player has properly located the thief and generates corresponding audible sounds indicating success or failure.

7 Claims, 9 Drawing Figures

STOP THIEF GAME

```
TMS0980 OBJECT: 'MP6101'CREATED 2/6/79   14:09:52 BY VERSION B(05/01/75) ASSM
+DPU        0000008001000180020002800300038004000480050005800600068007000780080 0
+DPU        0000000000000000000000000000000000000000000000000000000000000000000
+FETCH      00000   00
000110MP6101000601070 16B0079004001F6002900B00044006500BF00640048018B002F007F019D
011080MP6101006900640 06A01020060004000640 06F012C0029002A017300400068004100600 1FC
022620MP6101006600400 06A01EB002D01A5006C01510084002F0060002F004A006F002D002F0098
033E10MP6101019D00750066009E007F006F0072011B0060006F006800BF000D0087002F00400060
0447B0MP6101018B0160015B006F00440066019D00660007017C006C01EB008E0040011500BF005C
0550C0MP6101002800980 02F002F0128016B018B0029000400B000BF002F00B0003200070040006C
066CF0MP61010040008E019D0007006C002F00A00068017B011B002F00460063018B00440068000D
077C00MP6101016B01F60046007E0069009800B0011F0054004A00000046006C00320046004A00BF
088720MP61010032014A006F012F00290040002F0063004800070067011C004001FE0084002F002A
099C50MP61010060002A0072002F016C015C01EC013400000032003 3006C00620007002F0007011A
0AAEE0MP6101015500320100015 8007F010F01FE002F006F0059005E01220180002C008C00400007
0BBBE0MP6101002F0029003200040060000000600170006F002F012C0178012A004000BF01EB006E
0CC940MP6101017600440032018000000 04A0040012D008B008B0175016001C70040017E01C7013D
0DD6F0MP610100BF004B0048011800040083000 7006F008000440 12A002F006F0004012A0061002F
0EEE30MP6101002900B0002A0158016F01BD0147002A017300BF00EC007F0032004C015F0048006F
0FFC80MP6101006000400100004000610029000700690061002F006C01C1007F00440044002F006A
110240MP6101006000800 02F00BF0040006E00980105008C00400061006F002F0046013D006C01F5
121880MP610100BF00440080013101860046007F0040006000620007008000460098004400 6C013D
1322C0MP6101014101300046004000720060003 2006D01C1004201070147006800 6C0082014C0040
143530MP61010040006F006600BF01F5006001060114004600630068003201520 06C00600132018D
1546B0MP6101006000440180014900320 0B0002901800040006C00690007002F01070176004C002F
165BC0MP6101002F00480040006C00070080006D002F002D004400BF006F000701F6013D00400017C
176990MP6101002F016D002D0080013D008E00600032004001EE00980000006000460080006F01EB
1878A0MP61010063006F01EB006A01F6004E01A1006C00680084011200070064006B002F002F0040
198DD0MP6101003100460116003200880128002F01BD002F017C00BF016A002F002F00610068002F
1A9C20MP61010133002F0061004401F6006F008000650152002D011A004000600040002F002F0068
1BA230MP6101002201FE010F00460179004400000064008000440 08001BD01AD008401CA01100178
1CB7C0MP6101010E010F006B016B0032008E0068004600BF00200007004400800083015200680 06C
1DCFD0MP6101006F01690032014D006F00BF0060010F003201EB00320046006001620060006F0007
1ED380MP6101014A00400020006800400046008001 4C006001EB00070067011F00800040002F01AA
1FE9F0MP61010084006600800000004C01EB00330113013E0046002001600015017800 8E014D0009
20F290MP6101008C009E009A002F01270122002 9014F009A00E0004800E801FC013B014E01AA0032
2202E0MP6101002F0048011A01CC009A002A002E002F00960020009C00E0008300E1002F00420029
231290MP610100E900E801350133009E002B0083009A0046004C015B0080008D006001230171 0092
242950MP6101002F007800E800BF00060015001500060085004A00960168008400 8B017801460006
253740MP6101004C004201F5015C011C01600078015000290179009200 4600A0011601060096 0040
264650MP6101014900A20068008600E001530032008D004C000901EB01270032004000440042 0007
275740MP6101004000800079012A01BD01EB01EB008C0098008C014B00460100006800A700680061
286FC0MP6101006400A5006000BF0092009A006A00620062003 2006A00600064008600410060 0073
2974F0MP61010046006 2006B004101E7006700290060009A01E700680068006A0068006000620105
2A85F0MP6101009E006C006C0068011C00600067006400620 06C00BF006A00600042006401EF00E4
2B9C50MP6101006A009C006100BF00600060004400860 0BF00410064006D00620067006A0062006A
2CA520MP6101013B01AC0065009C00680044006B00610066004100630060006900 6E00680068006F
2DB870MP61010096006900600060006200610094006100660069 00E201EF01EF006A006100620067
2ECB10MP6101006D00420041006D00660063006401 2D004101F7009000960064006101 2D009800BF
2FDE50MP610100E400BF002F00900131006101FD01FB0060006A0064008500BF006B009A0068014D
30E7E0MP610100A70061009A00070089009A006501B40048004200E2018300690068009C009A0094
31FB10MP610100BF01270046004200 4001B60092006C017F00E400600150009E0032006000610023
```

*Fig. 7A*

330300MP6101006C00600040012A0069016C0048006100400060006000290041008500 6E01FB008E
341A50MP6101006800690046002900680100 00EC0042002F0164008900600123006A002F006A009C
352980MP6101006A014E0060002F006000410065002E009A00E10183006500BF0147006200410089
363760MP6101006700780 0E1006A007D017600460062007A0078002E006000600092014F006A0032
374EC0MP6101009A0068006000920020006600410066006400980060006600200 15B0096017B002C
385F40MP6101016801 1B0091006F004D004D012B008700E00045004D002900BF012D0065002F0096
3962A0MP6101006D009101750081 00E40107002A0125000D0032008A0100018000840067009200044
3A7A90MP6101009C0044016101330044011300290 06F00450100002F00EC00E8015E006B0104002F
3B8110MP6101006800BF01BD002F014F00E90046002F00880029000701A7009100910029009 8002F
3C98C0MP610100E2006F006A0029008C0041004000EA00800096002900E200EC006F0096009E011C
3DA0F0MP610100E80068006F008C00920032009A0046002D002B0165014A007F0125014A01EB0040
3EB0C0MP6101008400E4004001060098009200060 0B0006300800098002200920171000 6011F00B0
3FCB40MP6101006800750 13B00E600E201080040017D00EA0109000600820172 01B60044013C007E
40D8B0MP610101ED0048016E008A009601A70048006A002900E600E6004400E80073002F009600EC
41E790MP6101002F0091004001ED0078017E00920022006600330 09A010001A700480128013C0042
42F2E0MP6101016D010E016D00BF0029002F00290029009A0128008500480007 00EC01470033004D
440DB0MP6101018C0061004A00330044016D01360044012A0096012D004A00400135003201230044
451FD0MP610101E800440042008900 8A009A00EC00E2002F009600FA00A0006E0092018E00440092
4626A0MP6101013600E4008A00E4004E00E20089016D006000BF009A01360029004401750032017A
473C80MP6101012D00E0004E00460136009600E9009C010F017A01750084006000480000 105009A
4845E0MP6101015800EC013A0032012D0020009A00280051002300 9A015F013500E400F600920048
495E80MP6101012D012D00040133008501350137004200 9A0089002B012D0100002F004C0090012D
4A6DF0MP6101004400E2009800BF00A5002B009E00500048011500E200C5000700A600A400BF0126
4B7F20MP6101016100EA002A012E00EE009600EE0078002A0000005900C5009C00440089007100A2
4C8A20MP6101009400 2A00E600E00196002101690 12D0085004C016300E8002900A70145002A0160
4D9C90MP6101004800850029002B0004017C00BF012F01060130017000400096002200A0009A00EE
4EA380MP6101007D004C009A00A1010100280058008D008D012D00BF00290004016D014700420028
4FB600MP61010044002F0178017D005500E400000042010B002201E800EE009200E80001010B012F
50C380MP6101010B015B01120042012301EC010B015B00440021000900 8D004001B6002901CF0096
51DB00MP61010029009A008D00960166002901 0B009A0096010B00480152010B015B009E0134009A
52EF10MP6101009201300089017800420168009601270 08D00E1009E00810174004400420082 00A4
53FBA0MP6101003300000115 01C50089009600E000EE00090089011201330042008900 9A01310096
550D20MP61010040009A015B015B0009012A01E8002900090090016C0040002F0048009A00A60004
561960MP6101008901D701B40021014B008E00480048002000860001016200E20042013A01700089
572990MP6101004800010040 00BF00A60029010800A100A700A4009001B6008901000092000000081
583B30MP6101004200070042004400070159019600420 10D0029015101D70158009C00F900290044
594CE0MP6101008900480108008B009A01300060007200EE0069002D00890004017E01DC004200E8
5A5A20MP61010009004A01590029018C01150020006900 8D0067010E0085002F008E0040006E00BF
5B6500MP610100E8002F0006009A00A60164009C0089009C01C50000004A00BF0114016A009A0089
5C77D0MP61010020016C004C01A701090020011A00920068008A0153009200FA0081008B004A0136
5D8BE0MP61010100004C00420068016101 4E00A500A50092006401B4010A01310134004C007F008B
5E93C0MP61010137009A00600159002900900 08B004A0089003200BF01DC015C015D004C01B600A7
5FAA40MP6101002200200042012F00EE00420042000000 8B00200101013E0032011B015900E400BF
60BED0MP6101006A002F0029009200A2016000290114008 2008F0100008E0098009A00290165010B
61CD40MP61010009004C004A004A00800144004E0087006C00900044017F006800E00040018201BB
62D620MP6101004000E4008000940060 00A6008D00480042008600220 0A4006800A7010900290088
63E410MP6101009A00320000006F004000E8002901260029010 7004A007B01FB008C009201270090
64F300MP6101009401160 09C00640125008D009A0105009C0060009000A40090017000A200290180
660460MP6101006100 9A009A002C004A008B01B700E000A6004E00E8002901E8017100920127010B
671900MP6101004400 8B0006009C00420044000401000177002F009C002C007B017D00EC002F0179
6826D0MP6101003300910163002C004E00060148009601ED00FA0007007A01050167002900 9601ED
693980MP6101008401 4E00820122002900 9A00220108010000860048002F0020002900A200F70089
6A4250MP6101000401D3009C00840178003300 9E009E00060029009C00890115000 9014F0044004A
6B5250MP6101004001 5C002F0033002A00A001E80092007A017C017E00850040009C009200F20081
6C65C0MP6101004801E8004400810033016400420088004D014B011A0166010000830046013101 68
6D7040MP6101004400960020000901 46004E004C003001E80131002F010A0044004400 4000BF002F
6E8D20MP6101003300870 08E008E009A00850045009400920 18F0029015A00BF00600091009200 8A
6F9DD0MP6101002801570046007500220107008700920000006F0046000401 18004C006601A90078
70A7C0MP6101000300900029000601070094001500 29016C013000E70033007800BF002F00900029
71B280MP6101007B00900134002 8004C00330042007400E90107002A00E7004C010401000083 0141

*Fig. 7B*

```
72CD60MP610101510090002201300 08F00980029008B008B0122005401180072002900090044 00E4
73D160MP6101005401700020010001 4C017101130074009800200 10C00BF002C01440044012F010F
74EB60MP6101002900710 08E00740029004C00E2012900830003000300940028007 8010B00080007
75F540MP610101C1002F008F00460154009200780 02D00420074009800420 0E40118014D006F01A9
770EA0MP61010071009E00070168016200900170003301250 09C0007015C00680042009C017E009E
7818D0MP6101010700680 18D0092009C0138009400EC00200092004000900 0C90006018D01230003
792C70MP6101004C012D018D002A00C0006F011A0061002F0006007E00EA00A0004200E4013B0123
7A3D60MP6101016500290 0E7006100E20092004C0087009A011A0096008A006F004E00400042004E
7B4740MP6101009001230 02B004F0165004300BF004C00A600BF015C006F0087006401060165 0165
7C5A60MP610100BF00900006014D01190006004E00610165004201680007002100400003014 3015B
7D6F80MP6101019801 8D018D002F00440023010001370009006F006C002D002F006F002301440090
7E7460MP6101002A0165018D009C000D004E00B0002B002C002B0175017700E6009C00A30043002F
7F86C0MP6101008401 7301B7009A00050091004D00680000000000000000000000000000000000000
809EF0MP6101000000000000000000000000000000000000000000000000000000000000000000000
81ADE0MP6101000000000000000000000000000000000000000000000000000000000000000000000
82BCD0MP6101000000000000000000000000000000000000000000000000000000000000000000000
83CBC0MP6101000000000000000000000000000000000000000000000000000000000000000000000
84DAB0MP6101000000000000000000000000000000000000000000000000000000000000000000000
85E9A0MP6101000000000000000000000000000000000000000000000000000000000000000000000
86F890MP6101000000000000000000000000000000000000000000000000000000000000000000000
```

*Fig. 7C*

ELECTRONIC BOARD GAME APPARATUS

BACKGROUND OF THE INVENTION

This invention relates to a board-type game and more particularly to a board-type game in which digital computing apparatus is provided to generate audible clues representing the movement of a hidden or invisible player upon the board.

While various prior art board games have employed various arrangements for concealing each player's pieces from his opponent, relatively few have employed a hidden or invisible player whose location is not known to any of the participants. One exception is the Parker Bros. game CODE NAME: SECTOR which is disclosed in applicant's earlier patent 4,171,135. One of the foreseeable problems is the provision of some means for controlling the behavior of the hidden opponent in a manner which is consistent with some predetermined set of rules of play. Likewise, it was heretofore difficult to provide any means for communicating the behavior of the hidden opponent to the human players or participants. In accordance with one aspect of the present invention, special-purpose digital computing apparatus is provided to both logically control the hidden opponent's behavior and to generate clues which give limited information about that behavior to the human participants in the game, while permitting the participants themselves to operate on a classic type of board playing field with its historically well-received visual attributes.

SUMMARY OF THE INVENTION

Game apparatus in accordance with the present invention involves playing field means such as a folding board carrying visible indicia defining a multiplicity of locations and permissible paths of movement between locations along which players can move representative tokens. A digital processor is provided with means comprising a fixed table of information representing the various playing field locations together with data representing the character of each location. Sound generating means are provided which are energizable by the processor to produce a selected one of a plurality of predetermined sounds, each of the predetermined sounds being characteristic of one type of location. A writable memory or register means is provided for storing the value representing a location on the playing field, i.e. the location of the hidden opponent. The stored value is alterable by means including a random number generator, operable upon player initiation, with the alteration being in conformance with predetermined rules based on said fixed table thereby to effect a corresponding change in the location represented by the stored value. The changes are thus unpredictable though in conformity with the rules. Upon each change, the sound generating means is activated to generate the preselected sound corresponding to the movement occurring. Player operable means are provided for initiating a capture operation and designating a location submitted to correspond to the current stored value. The repertoire of the sound generating means includes also predetermined sounds corresponding to a failure and success in matching the current stored value, the processor being operative to initiate the appropriate success or failure sound in the case of match or mismatch, respectively.

BRIEF DESCRIPTION OF THE DRAWINGS

FIGS. 7A–7C comprise a table representing the binary code stored in the read only memory portion of the microcomputer of FIG. 6.

Corresponding reference characters indicate corresponding parts throughout the several views of the drawings.

DESCRIPTION OF THE PREFERRED EMBODIMENT

Figure 1:
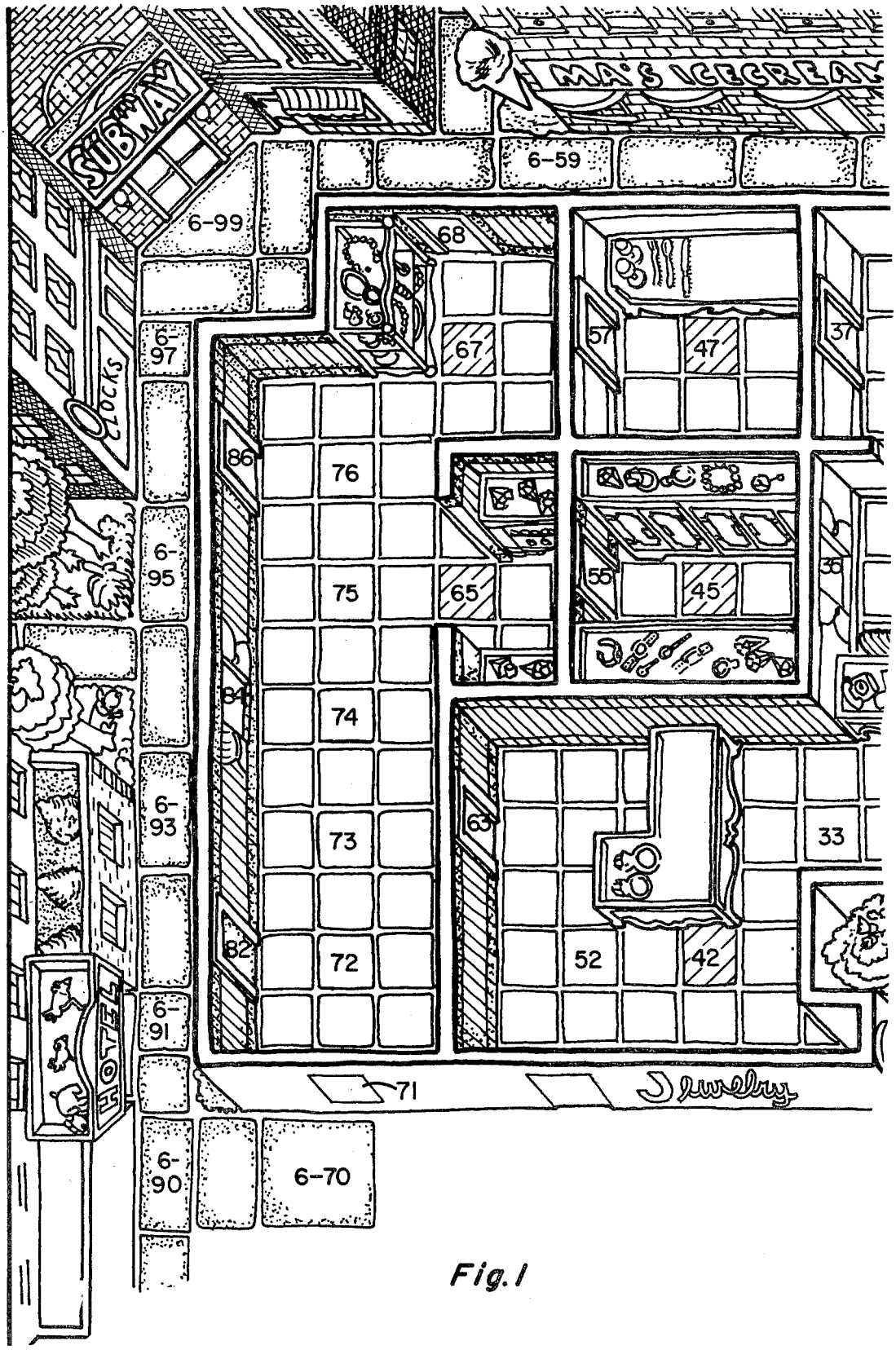
FIG. 1 is a plan view of a portion of a playing field board in the game of the present invention.
Figure 2:
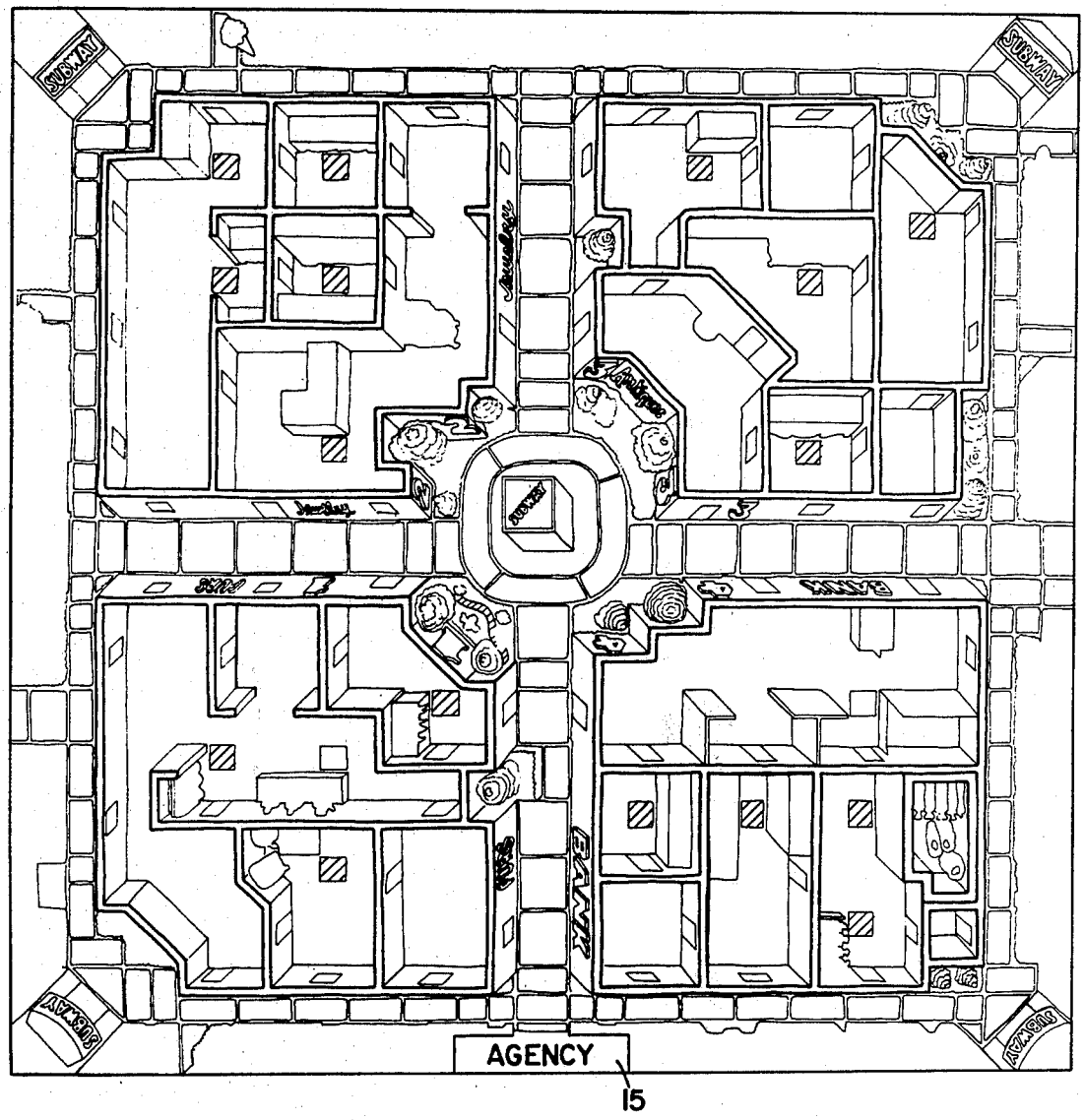
FIG. 2 is a view, to much reduced scale, showing how the portion of FIG. 1 fits into an overall board pattern.

Referring now to FIGS. 1 and 2, the board layout illustrated there is that employed in a commercial version of the game of the present invention sold under the trademark STOP THIEF. The overall layout represents four buildings together with adjacent streets. The buildings are partitioned into rooms, as may be seen from FIG. 1, and both the buildings and the street are divided into multiple playing locations or squares. Basically, the game involves having the human players move representative tokens so as to pursue and hopefully capture a hidden or invisible player, the thief, whose location is not initially known to the participants and whose location changes during the course of the game. As suggested previously, the location of the hidden opponent is generated and controlled by a digital computer device which, in normal operation, only provides limited clues as to the hidden opponent's location.

In addition to being subdivided into various locations, the board's indicia also provides an indication of character as to each location, i.e. street, floor, doorway, window, or crime location. In the embodiment illustrated, the locations which the thief may occupy are somewhat more limited than those which can be occupied by players and these limited locations are identified by being given discrete numeric identifiers. The participants or players on the other hand can move on what is, in effect, a finer grid of player locations. This finer grid is convenient for allowing the extent of movement of each player upon his turn to be determined by the throw of dice.

Both the thief and the players move in accordance with predetermined rules. Neither the thief nor the players are allowed to go over walls of a building. Both may go through doorways but only the thief can go through a window. In FIGS. 1 and 2, windows can be distinguished from doors by the presence of a higher sill.

Certain locations within each of the buildings are marked as crime locations. These are cross-hatched in FIGS. 1 and 2. A thief arriving at such a location is assumed to steal the valuables represented on the board. Once the thief has taken the valuables illustrated with a given crime location, that location is then treated as an ordinary floor location until the thief leaves the building, i.e. allowing the owners to replace the valuables according to the theory of the game.

At the start of a game, each player places a token representing himself at a common beginning point, the "detective agency" location indicated by reference character 15 in FIG. 2. Upon each person's turn, he initiates a movement of the thief, receives a clue as described hereinafter and then throws the dice to determine how many locations he may step off in pursuing the thief. Basically, each segment of the game proceeds with the players taking turns until one of the players believes his token is at or adjacent the thief's location. At such time, that player may attempt an arrest and test his supposition with the digital electronic device described hereinafter.

Figure 3:
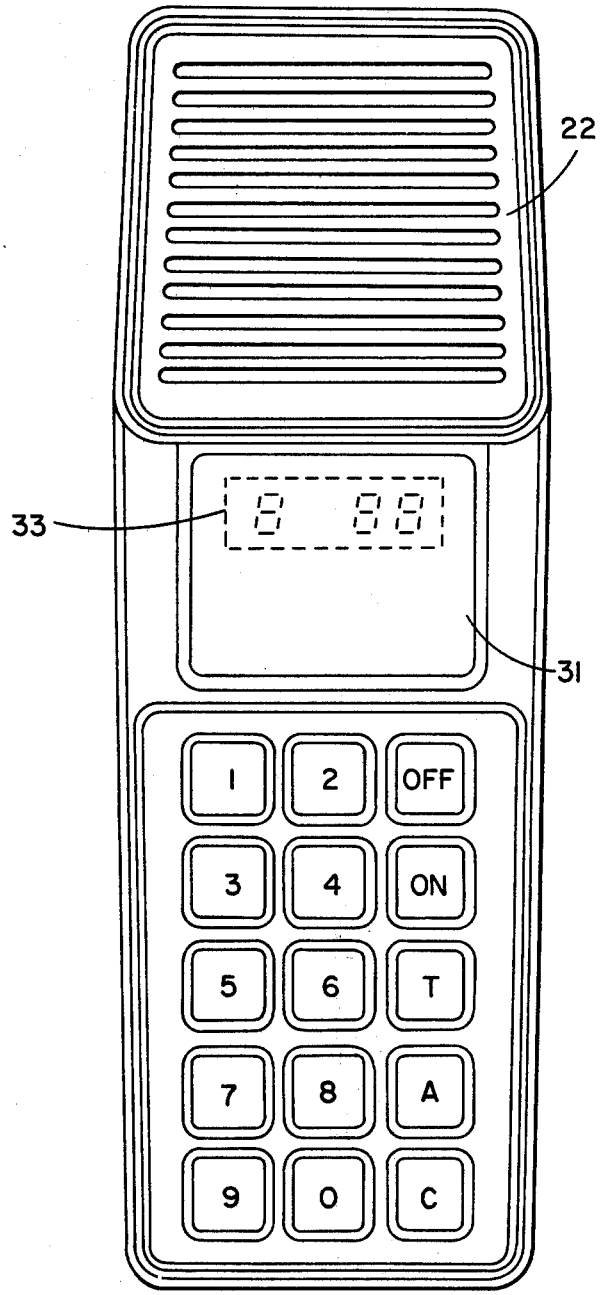
FIG. 3 is a plan view of a digital electronic device employed in the game of the present invention for controlling and tracking the movement of a hidden opponent and for generating audible and visual clues relating to the hidden opponent's movement.
Figure 4:
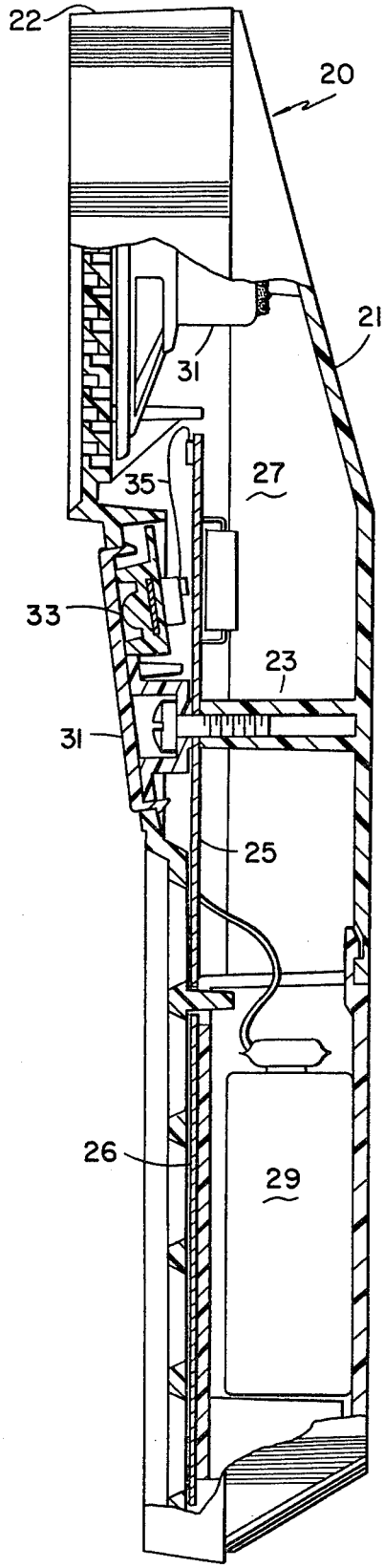
FIG. 4 is a side view, with parts broken away, of the device of FIG. 3 showing the arrangement of various components therein.

The mechanical arrangement of the handheld electronic device which provides clues as to the whereabouts of the hidden thief and other interactive playing features is illustrated in FIGS. 3 and 4. A molded plastic housing 20 comprises a base portion 21 and a cover portion 22 which is secured to the base by a clamp screw 23 and by interlocking ridges (not shown) at the mating edges. Clamped between the cover 22 and the base 21 is a printed circuit board 25. The lower portion of the printed circuit board 25 comprises a keyboard section 26 while the upper portion carries electronic circuitry as described hereinafter, including a single chip microcomputer 27. A battery 29 is enclosed in the lower portion of the base 21 and is provided with leads connecting it to the circuit board 25. The upper portion of the housing contains a loudspeaker 31 which is also connected to the circuitry on the board 25.

The keyboard 26 is, in the embodiment illustrated, of the conventional type in which interdigitated conductors are applied on the surface of the printed circuit board 25, these conductors being selectively bridged by a conductive spot on an overlying flexible diaphragm when a respective key location is touched by an operator's finger.

While most of the housing is preferably opaque, the cover 22 carries a transparent, ruby-tinted window through which a calculator-type seven-segment display 33 may be viewed. Display 33 is connected to the circuit board 25 by a flat, ribbon-type conductor 35.

Figure 5:
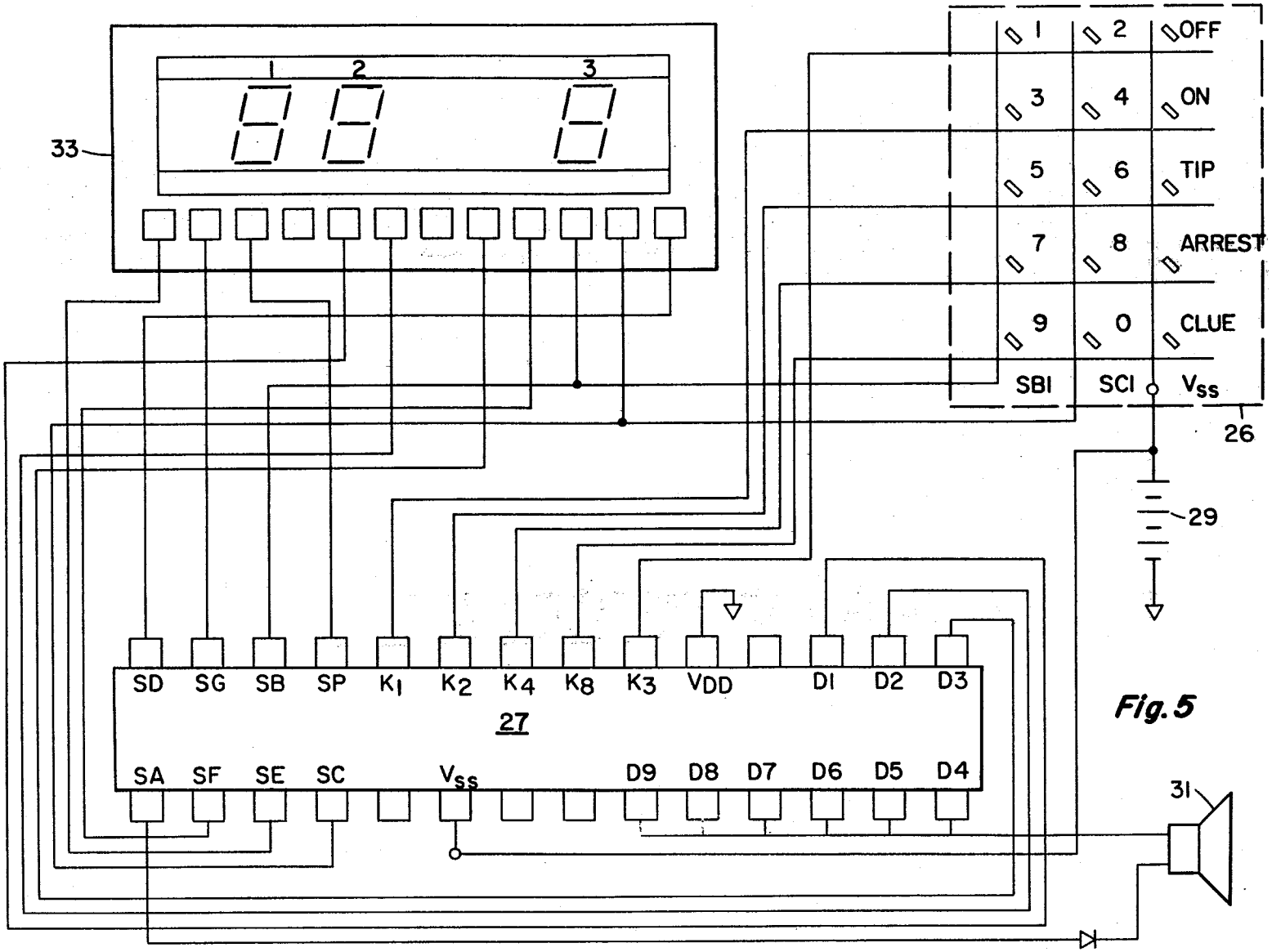
FIG. 5 is a circuit diagram illustrating the interconnection of components in the device of FIGS. 3 and 4.

The keyboard is arranged to provide ten keys, 1 through 9 and 0, for the entry of numeric data and five control keys. The control keys are "OFF", "ON", "T"(TIP), "A"(ARREST), and "C"(CLUE). The complete circuitry contained in the apparatus of FIGS. 3 and 4 is illustrated in FIG. 5 and is itself relatively simple. As will be understood by those skilled in the art, the microcomputer 27 itself comprises the capability to scan and interpret the keyboard, to drive the display 33 in a multiplexed mode, and to produce waveforms suitable for energizing the speaker 31 so that it emits various sounds. As will also be understood by those skilled in the art, the particular sounds generated and the interactive responses to the operation of the keyboard are dependent upon the program which is stored in the ROM section of the microcomputer.

The basic function of the digital computer apparatus is to implement a random number generating function for initially choosing a location for the thief and for selecting subsequent moves of the thief in an unpredictable manner. Each such move is initiated by the player whose turn is up by operating the "C"(CLUE) key on the keyboard 26. When the thief moves, the device also generates an audible clue as described hereinafter. The random number generating routines utilizes the random access writable memory (RAM) portion of the microcomputer 27 as do various of the other of the program segments stored in the read only memory portion of that device. Likewise, the value representing the current location of the thief is kept in RAM. The computing apparatus, however, also includes a fixed table of information representing the board locations which may be occupied by the thief and, for each location, the character of that location. This is essentially in the form of a directory of possible next locations or moves which are in accordance with the rules. The device is programmed so that the movements of the thief, though unpredictable, are in correspondence with rules correlating to the indicia printed on the board of FIG. 1. The thief will not, for example, pass through walls. Each individual move of the thief is only from one numbered location to an adjacent numbered location.

In addition to effecting periodic changes in the data representing the hidden player's location, the electronic device also provides audible and visible clues regarding the thief's location each time the thief moves. For this purpose, the device includes the loudspeaker 31 and a 7-segment LED array 33 as may be seen in FIGS. 3 and 4. The processor is programmed to generate a characteristic sound accompanying each of the thief's moves which sound characterizes the type of location to which the thief is moving. While the sounds most easily implemented with straightforward microprocessor circuitry are somewhat more musical than exact sound effects, sufficient characteristics are easily obtainable to allow accurate correlation by the players with a type of location intended. In the embodiment illustrated, the following types of sounds were utilized as location clues.

| LOCATION | SOUND | SYMBOL |
|---|---|---|
| Crime | Wailing siren (alarm) | Cr |
| Floor within building | A pair of short squeaks | Fl |
| Door opening | Slow rising squeak | Dr |
| Window (Breaking) | Tinkling glass | Gl |
| Street | Clopping | St |
| Subway | Clicking rails | St |

In addition to the sound clue generated, the processor energizes the LED display to indicate on the right hand pair of alphanumeric symbols indicating the type of location. Corresponding symbols are indicated in the above table to the right of the sound characteristics. The leftmost digit of the display is also energized to indicate the number of the building or street in which the thief is then located thereby providing a clue for further narrowing the locations which need to be considered by the players. The types of locations are varied and arranged on the board so that a sequence of audible clues can eventually be associated, by the players, with patterns of locations on the board, thereby to find the thief.

As indicated previously, the game proceeds until one of the players believes he is at or adjacent the thief's location. At this point, the player initiates an arrest operation. This is done using the digital electronic device's keyboard 37. The player performs the arrest by first pressing the ARREST button and then pressing numbered buttons in sequence to designate first the building or street where the arrest is to be made and then the specific location. The processor is programmed to compare the location value entered by the player with the stored value representing the then current location of the thief.

The repertory of the sound generating portion of the device's program includes sounds corresponding to failure and success in matching the current thief's location. The processor initiates the appropriate success or failure sound in the case of match or mismatch, respectively. In each case, the particular embodiment illustrated emits a wailing siren sound to simulate police being summoned. If a match was obtained, simulated gunshots are heard and a paddy wagon type sound (high/low alternating horn) is given to indicate that the thief is being taken away. If a mismatch is obtained on the other hand, a "raspberry" discordant sound is emitted in place of the shots and paddy wagon sound. To provide a further element of chance, the thief is, in the commercial embodiment illustrated, occasionally allowed to escape even though a proper match is obtained. In this case a nyeah-nyeah sound is generated.

Figure 6:
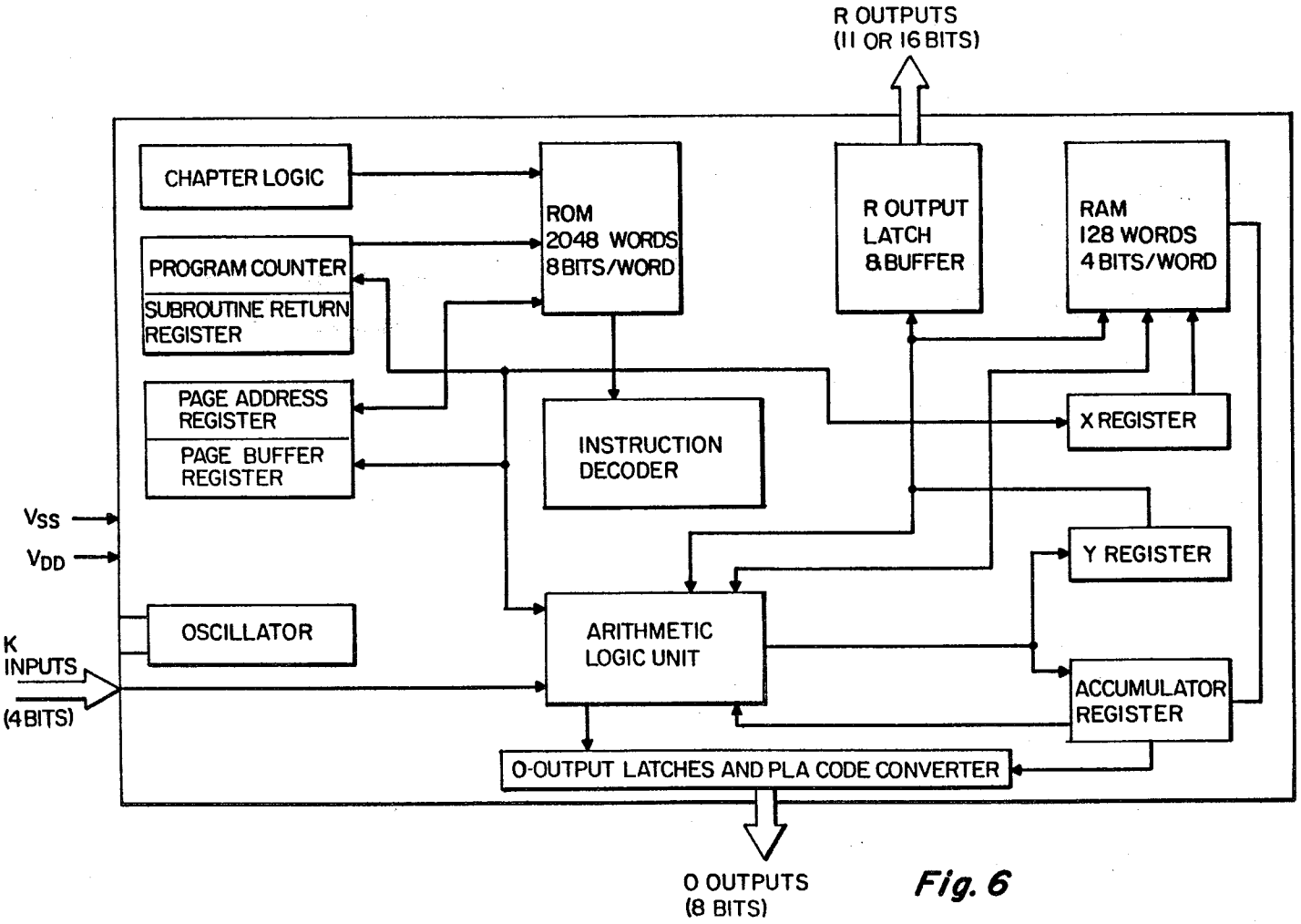
FIG. 6 is a block diagram of the integrated circuit microcomputer employed in the circuit of FIG. 5.

In the particular embodiment illustrated, the digital processor, the fixed table representing the playing field locations together with their character, the algorithms for generating random number sequences and for generating predetermined sounds are all incorporated in a single chip microprocessor. In this version, the particular processor is the Texas Instruments Model TMS-0980 single chip microcomputer. A block diagram of this particular microcomputer, obtained from the commercial literature of the source company, is shown in FIG. 6. The manner in which this microcomputer is interconnected with the speaker 31, the LED array of the keyboard 37, is illustrated in FIG. 5.

As indicated previously, both the fixed table representing the playing field board and the algorithms for random number and sound pattern generation are incorporated in the overall microcomputer itself, this code being entered into the ROM portion of the microcomputer memory during manufacture. As is understood by those skilled in the art, this technique of incorporating customer code in an otherwise standard microcomputer chip is available through a variety of manufacturers at the present time and it should be understood that this game could be implemented with the processors available from other sources and that the particular detailed code would depend upon the instruction set available with the particular microprocessors available through those manufacturers. The actual code employed in a commercial version of this game using the TMS-0980 microcomputer is given in FIG. 7, the form of presentation (hexadecimal) being that taken as standard by the manufacturer.

In addition to the basic game described above, the particular commercially implemented version illustrated herein provides additional features and embellishments. While, in general, the thief moves only from one numbered location to an adjacent numbered location, an exception exists when the thief reaches one of the subway entrances. He is then permitted on his next move to emerge at any of the other subway stations and to proceed from that point. Thus, though not physically contiguous on the playing board, these locations may be considered to be topographically contiguous in the underlying concept of the game and the fixed table stored in the microprocessor read-only memory reflects this fact. Likewise, the repertory of sound clues preferably includes a further sound which mimics clicking rails as heard when riding on a subway so as to be able to fairly clue the players that the thief has made such a move.

Further, the commercial version of the game provides various player embellishments and a means of scoring over several game segments to select an overall game winner. For scoring, a reward is placed on the head of each thief, which reward is turned over to the capturing player. These different thieves are entered into the game in succession by turning cards of a shuffled deck. The first player to accummulate a preselected sum of the reward money is considered the winner. Likewise, the players are provided with dealt "sleuth" cards, each of which, when played at the start of a turn, gives a player a stated advantage, such as, allowing him to initiate extra clue operations from the digital processor device to make extra steps along the board or to impose certain penalties on other players. As will be understood these features have analogs in other games such as the games of Monopoly and Clue and are essentially apart from the novel features of the present game. However, one particular bonus which a player can obtain utilizes the digital electronic apparatus of the present invention. If the player is dealt a particular type of sleuth card, or otherwise obtains such a right, he utilizes the advantage by pressing the T(TIP) control key on the keyboard 26. The microcomputer 27 is programmed to respond to this operation by actuating the display 33 to indicate the current location of the thief. This allows a player, who believes he is close enough to make an arrest, to confirm his suspicions under situations involving ambiguity, i.e. where there are one or more possible locations which could have been reached by the thief, following a trail generating the same sequence of audible clues. Part of the skill involved in playing the game is thus in determining when to play such rights as well as determining the thief's possible locations from the sequence of audible clues.

While the present invention was always conceived as a hand-held, wholly electronic device capable of battery powered operation, initial prototypes were constructed using a developmental or prototyping system manufactured by the Intel Corporation of Sunnyvale, Calif. so that initial programming could be performed using a standard, high level language. This prototyping was done with the understanding that substantial code compaction could then be performed to implement essentially the same system using a single chip microcomputer in which the program code was entered into the read only memory of the microcomputer during manufacture. The prototype program, written in PL/M, is reproduced in Appendix A attached to this application.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

- APPENDIX A -

```
STOPTH: DO; /* 2-4-79  WORKS WITH REGULARLY SPACED BOARD   AND SE BOARD*/
        DECLARE DCL LITERALLY 'DECLARE';
        DCL LIT LITERALLY 'LITERALLY';
        DCL CRIMELOC(18) ADDRESS DATA
            (23,44,46,64,142,145,147,165,167,
             237,252,255,276,325,345,363,365,367);
        DCL CLUE(403) BYTE DATA(
               14,7,0,7,0,7,0,7,0,7,    7,0,0,85H,0,0,0,85H,0,7,
                0,0,0,44H,5,5,4,4,86H,0,        7,85H,4,0,0,0,5,0,0,7,
                0,0,5,0,44H,0,44H,4,86H,0,      7,86H,4,4,4,0,0,5,0,7,
                0,0,5,0,44H,5,4,4,85H,0,        7,86H,4,4,0,0,4,0,0,7,
                0,0,85H,0,0,86H,0,0,0,0,        7,7,0,7,0,7,0,7,0,7,

                9,7,0,7,0,7,0,7,0,47H,  7,0,0,0,85H,0,0,86H,0,7,
                0,0,0,4,0,4,4,4,86H,0,  7,86H,0,4,0,6,0,5,0,7,
                0,0,44H,0,0,44H,0,44H,0,0,      7,85H,4,0,0,5,0,5,0,7,
                0,0,0,5,0,44H,0,44H,85H,0,      7,86H,4,4,4,4,4,0,0,7,
                0,0,85H,0,86H,0,85H,0,0,0,      7,7,0,7,0,7,0,7,0,7,

                9,7,0,7,0,7,0,7,0,47H,  7,0,0,0,85H,0,0,86H,0,7,
                0,0,0,0,4,5,4,4,85H,0,  7,85H,4,4,0,0,0,44H,0,7,
                0,0,6,0,5,4,0,5,0,0,    7,86H,44H,0,4,44H,0,4,86H,7,
                0,0,5,0,0,5,0,5,0,0,    7,86H,4,5,4,4,44H,0,0,7,
                0,0,0,0,86H,0,85H,0,0,0,        7,7,0,7,0,7,0,7,0,7,

                9,7,0,7,0,7,0,7,0,7,    7,0,0,85H,0,0,0,0,0,7,
                0,0,0,4,5,44H,5,4,86H,0,        7,0,4,0,0,0,0,5,0,7,
                0,85H,4,4,5,44H,4,4,86H,0,      7,0,4,0,0,0,5,0,0,7,
                0,0,0,44H,5,44H,4,44H,85H,0,    7,85H,4,0,0,0,0,5,0,7,
                0,0,86H,0,0,0,0,85H,0,0,        7,7,0,7,0,7,0,7,0,7,

                9,9,7);
        DCL POSSIBLE(403) STRUCTURE(DIRECTION(6) ADDRESS) DATA(
            0,  0,  0,  0,  0,  0,      402,3,0,0,  0,  0,
            0,  0,  0,  0,  0,  0,      1,313,5,13,  0,  0,
            0,  0,  0,  0,  0,  0,      3,7,  0,  0,  0,  0,
            0,  0,  0,  0,  0,  0,      5,9,17,  0,  0,  0,
            0,  0,  0,  0,  0,  0,      7,319,19,0,  0,  0,

            402,1,130,0,  0,  0,          0,  0,  0,  0,  0,  0,
            0,  0,  0,  0,  0,  0,      3,24,23,  0,  0,  0,
            0,  0,  0,  0,  0,  0,        0,  0,  0,  0,  0,  0,
            0,  0,  0,  0,  0,  0,      7,28,27,26,  0,  0,
            0,  0,  0,  0,  0,  0,      9,39,28,  0,  0,  0,

            0,  0,  0,  0,  0,  0,        0,  0,  0,  0,  0,  0,
            0,  0,  0,  0,  0,  0,      13,24,32,    0,  0,  0,
            13,25,23,0,  0,  0,         24,26,36,  0,  0,  0,
          25,17,27,36,0,0,              17,28,36,26,0,0,
          17,19,27,39,0,0,              0,0,0,0,0,0,

          110,31,150,131,0,0,   130,32,42,0,0,0,
          31,23,42,0,0,0,               0,0,0,0,0,0,
            0,  0,  0,  0,  0,  0,        0,  0,  0,  0,  0,  0,
          25,26,27,47,46,0,             0,0,0,0,0,0,
          0,0,0,0,0,0,                  28,19,28,59,48,0,

            0,  0,  0,  0,  0,  0,        0,  0,  0,  0,  0,  0,
          31,32,53,52,51,0,             0,0,0,0,0,0,
          54,53,0,0,0,0,                0,0,0,0,0,0,
          36,47,57,0,0,0,               36,48,57,46,0,0,
          47,39,59,57,0,0,              0,0,0,0,0,0,

          130,51,170,151,0,0,           150,42,52,62,0,0,
          42,53,62,51,0,0,              42,44,54,64,62,52,
          44,64,65,53,0,0,              0,0,0,0,0,0,
          0,0,0,0,0,0,                  46,47,48,68,67,66,
          0,0,0,0,0,0,                  48,39,79,68,0,0,
```

```
0,0,0,0,0,0,                    0,0,0,0,0,0,
51,52,53,73,72,71,              0,0,0,0,0,0,
53,54,65,73,0,0,                54,66,76,64,0,0,
65,57,67,76,0,0,                57,68,76,66,0,0,
57,59,79,67,0,0,                0,0,0,0,0,0,

150,71,190,171,0,0,             170,62,72,82,0,0,
62,73,82,71,0,0,                62,64,82,72,0,0,
0,0,0,0,0,0,                    0,0,0,0,0,0,
65,66,67,85,0,0,                0,0,0,0,0,0,
0,0,0,0,0,0,                    68,59,99,0,0,0,

0,0,0,0,0,0,                    0,0,0,0,0,0,
71,72,73,93,91,0,               0,0,0,0,0,0,
0,0,0,0,0,0,                    76,95,0,0,0,0,
  0,  0,  0,  0,  0,  0,          0,  0,  0,  0,  0,  0,
  0,  0,  0,  0,  0,  0,          0,  0,  0,  0,  0,  0,

170,91,191,0,0,0,               190,82,93,0,0,0,
0,0,0,0,0,0,                    91,82,95,0,0,0,
0,0,0,0,0,0,                    85,97,93,0,0,0,
0,0,0,0,0,0,                    95,99,0,0,0,0,
0,0,0,0,0,0,                    79,100,97,0,0,0,

99,200,300,400,401,0,           203,310,402,110,0,0,
0,0,0,0,0,0,                    205,214,201,114,0,0,
0,0,0,0,0,0,                    207,203,214,114,0,0,
0,0,0,0,0,0,                    217,205,117,209,0,0,
0,0,0,0,0,0,                    207,119,219,0,0,0,

402,130,0,0,0,0,                0,0,0,0,0,0,
0,0,0,0,0,0,                    0,0,0,0,0,0,
205,203,123,125,0,0,            0,0,0,0,0,0,
0,0,0,0,0,0,                    207,126,127,128,0,0,
0,0,0,0,0,0,                    209,128,139,0,0,0,

0,0,0,0,0,0,                    0,0,0,0,0,0,
0,0,0,0,0,0,                    114,133,0,0,0,0,
0,0,0,0,0,0,                    114,135,126,0,0,0,
117,125,135,137,127,0,          117,126,137,128,0,0,
117,127,137,139,119,0,          0,0,0,0,0,0,

110,31,150,131,0,0,             130,142,0,0,0,0,
0,0,0,0,0,0,                    123,142,0,0,0,0,
0,0,0,0,0,0,                    126,125,145,0,0,0,
0,0,0,0,0,0,                    128,127,126,147,0,0,
0,0,0,0,0,0,                    119,128,159,0,0,0,

0,0,0,0,0,0,                    0,0,0,0,0,0,
133,131,151,152,0,0,            0,0,0,0,0,0,
0,0,0,0,0,0,                    135,155,0,0,0,0,
0,0,0,0,0,0,                    137,157,0,0,0,0,
0,0,0,0,0,0,                    0,0,0,0,0,0,

130,51,170,151,0,0,             142,150,152,0,0,0,
142,151,163,0,0,0,              0,0,0,0,0,0,
0,0,0,0,0,0,                    145,165,0,0,0,0,
0,0,0,0,0,0,                    147,167,168,0,0,0,
0,0,0,0,0,0,                    139,168,179,0,0,0,

0,0,0,0,0,0,                    0,0,0,0,0,0,
0,0,0,0,0,0,                    152,172,173,174,0,0,
0,0,0,0,0,0,                    155,174,175,176,0,0,
0,0,0,0,0,0,                    157,176,168,0,0,0,
157,159,167,179,0,0,            0,0,0,0,0,0,

150,71,190,171,0,0,             170,172,182,0,0,0,
163,171,182,173,0,0,            163,172,182,184,174,0,
165,163,173,184,175,0,          165,174,184,186,176,0,
167,165,175,186,0,0,            0,0,0,0,0,0,
0,0,0,0,0,0,                    159,168,199,0,0,0,
```

```
0,0,0,0,0,0,                    0,0,0,0,0,0,
173,172,171,191,193,0,          0,0,0,0,0,0,
175,174,173,193,195,0,          0,0,0,0,0,0,
176,175,195,197,0,0,            0,0,0,0,0,0,
0,0,0,0,0,0,                    0,0,0,0,0,0,

170,91,191,0,0,0,               182,190,193,0,0,0,
0,0,0,0,0,0,                    184,191,195,182,0,0,
0,0,0,0,0,0,                    186,184,193,197,0,0,
0,0,0,0,0,0,                    186,195,199,0,0,0,
0,0,0,0,0,0,                    179,197,200,0,0,0,

199,100,300,400,401,0,          203,402,0,0,0,0,
0,0,0,0,0,0,                    214,201,114,205,0,0,
0,0,0,0,0,0,                    214,203,114,207,0,0,
0,0,0,0,0,0,                    217,205,117,209,0,0,
0,0,0,0,0,0,                    219,207,119,0,0,0,

402,330,1,201,0,0,              0,0,0,0,0,0,
0,0,0,0,0,0,                    0,0,0,0,0,0,
225,224,203,205,0,0,            0,0,0,0,0,0,
0,0,0,0,0,0,                    228,227,226,207,0,0,
0,0,0,0,0,0,                    239,228,209,0,0,0,

  0,  0,  0,  0,  0,  0,          0,  0,  0,  0,  0,  0,
  0,  0,  0,  0,  0,  0,          0,  0,  0,  0,  0,  0,
233,214,225,0,0,0,              224,214,226,0,0,0,
225,237,227,217,0,0,            237,226,217,228,0,0,
239,237,227,217,219,0,          0,0,0,0,0,0,

350,341,310,231,0,0,  242,330,232,0,0,0,
242,231,233,0,0,0,              244,242,232,224,0,0,
  0,  0,  0,  0,  0,  0,          0,  0,  0,  0,  0,  0,
  0,  0,  0,  0,  0,  0,        247,226,227,228,0,0,
0,0,0,0,0,0,                    259,228,219,0,0,0,

0,0,0,0,0,0,                    0,0,0,0,0,0,
252,251,231,232,233,0,          0,0,0,0,0,0,
255,254,233,245,0,0,            255,254,244,0,0,0,
0,0,0,0,0,0,                    258,257,237,0,0,0,
0,0,0,0,0,0,                    0,0,0,0,0,0,

370,341,330,351,0,0,            262,350,242,252,0,0,
262,251,242,0,0,0,              0,0,0,0,0,0,
265,244,245,255,0,0,            265,254,244,245,0,0,
0,0,0,0,0,0,                    267,247,258,0,0,0,
267,257,247,259,0,0,            279,258,239,0,0,0,

0,0,0,0,0,0,                    0,0,0,0,0,0,
273,272,271,251,252,0,          0,0,0,0,0,0,
0,0,0,0,0,0,                    276,275,274,254,255,0,
0,0,0,0,0,0,                    276,257,258,0,0,0,
0,0,0,0,0,0,                    0,0,0,0,0,0,

390,371,350,271,0,0,            370,262,272,0,0,0,
271,262,273,0,0,0,              284,272,262,274,0,0,
284,273,265,275,0,0,            286,284,274,265,276,0,
286,275,265,267,0,0,            0,0,0,0,0,0,
0,0,0,0,0,0,                    299,258,259,0,0,0,

  0,  0,  0,  0,  0,  0,          0,  0,  0,  0,  0,  0,
  0,  0,  0,  0,  0,  0,          0,  0,  0,  0,  0,  0,
295,293,273,274,275,0,          0,0,0,0,0,0,
297,295,275,276,0,0,            0,0,0,0,0,0,
0,0,0,0,0,0,                    0,0,0,0,0,0,

391,370,291,0,0,0,              390,293,0,0,0,0,
0,0,0,0,0,0,                    295,291,284,0,0,0,
0,0,0,0,0,0,                    297,293,284,286,0,0,
0,0,0,0,0,0,                    295,286,299,0,0,0,
0,0,0,0,0,0,                    297,279,300,0,0,0,
```

```
299,401,100,200,400,0,          402,310,110,3,0,0,
0,0,0,0,0,0,                    313,1,13,5,0,0,
0,0,0,0,0,0,                    3,7,0,0,0,0,
0,0,0,0,0,0,                    5,9,17,0,0,0,
0,0,0,0,0,0,                    319,7,19,0,0,0,

330,402,0,0,0,0,                0,0,0,0,0,0,
0,0,0,0,0,0,                    324,323,3,0,0,0,
0,0,0,0,0,0,                    0,0,0,0,0,0,
0,0,0,0,0,0,                    0,0,0,0,0,0,
0,0,0,0,0,0,                    339,328,9,0,0,0,

0,0,0,0,0,0,                    0,0,0,0,0,0,
0,0,0,0,0,0,                    332,313,324,0,0,0,
323,313,325,0,0,0,              324,326,0,0,0,0,
325,337,327,0,0,0,              337,326,328,0,0,0,
337,327,319,339,0,0,            0,0,0,0,0,0,

350,341,231,310,0,0,  0,0,0,0,0,0,
343,342,341,323,0,0,            0,0,0,0,0,0,
  0,  0,  0,  0,  0,  0,          0,  0,  0,  0,  0,  0,
  0,  0,  0,  0,  0,  0,        348,347,346,326,327,328,
0,0,0,0,0,0,                    359,348,319,328,0,0,

0,0,0,0,0,0,                    350,352,342,330,332,0,
352,341,332,343,0,0,            352,342,332,344,0,0,
343,345,0,0,0,0,                344,356,346,0,0,0,
356,345,337,347,0,0,            356,346,337,348,0,0,
347,337,339,359,0,0,            0,0,0,0,0,0,

370,251,330,341,0,0,            0,0,0,0,0,0,
363,341,342,343,0,0,            0,0,0,0,0,0,
  0,  0,  0,  0,  0,  0,          0,  0,  0,  0,  0,  0,
367,366,365,345,346,347,        0,0,0,0,0,0,
0,0,0,0,0,0,                    379,368,348,339,0,0,

  0,  0,  0,  0,  0,  0,          0,  0,  0,  0,  0,  0,
  0,  0,  0,  0,  0,  0,        372,352,364,0,0,0,
363,365,0,0,0,0,                364,366,356,0,0,0,
377,365,356,367,0,0,            377,366,356,368,0,0,
377,367,359,379,0,0,            0,0,0,0,0,0,

390,271,371,350,0,0,            370,382,372,0,0,0,
382,371,363,0,0,0,              0,0,0,0,0,0,
0,0,0,0,0,0,                    0,0,0,0,0,0,
0,0,0,0,0,0,                    387,366,367,368,0,0,
0,0,0,0,0,0,                    399,359,368,0,0,0,

0,0,0,0,0,0,                    0,0,0,0,0,0,
391,393,371,372,0,0,            0,0,0,0,0,0,
0,0,0,0,0,0,                    0,0,0,0,0,0,
0,0,0,0,0,0,                    397,377,0,0,0,0,
0,0,0,0,0,0,                    0,0,0,0,0,0,

291,370,391,0,0,0,              390,382,393,0,0,0,
0,0,0,0,0,0,                    391,382,395,0,0,0,
0,0,0,0,0,0,                    393,397,0,0,0,0,
0,0,0,0,0,0,                    395,387,399,0,0,0,
0,0,0,0,0,0,                    397,379,400,0,0,0,

399,100,200,300,401,0,          402,100,200,300,400,0,
401,110,201,310,1,0);

DCL DIG(4) BYTE;
DCL IDIG(4) BYTE DATA(0,3,1,0);
DCL DIGIT(4) BYTE;
DCL BIT(8) BYTE DATA(1,2,4,8,10H,20H,40H,80H);
DCL NBIT(8) BYTE DATA(0FEH,0FDH,0FBH,0F7H,0EFH,0DFH,0BFH,7FH);
DCL (ST,ST1) ADDRESS;
DCL (EXCLUDE,JLT,LASTBUT) BYTE;
DCL NCOMMIT BYTE;
```

```
DCL COMMIT(19) ADDRESS;
DCL LASTSTEP LIT '30';
DCL RANDOM ADDRESS;
DCL RND(4) ADDRESS;
DCL (I,J,MASK) BYTE;
DCL (ARRESTFLAG,PRESSFLAG,NEXTFLAG,FIRSTTHIEF,NEXTTHIEFFLAG,TIPFLAG,
        CRIMEFLAG,CRIME1FLAG,RUNFLAG,NEWBUT) BYTE;
DCL (SIREN,NYAH,CRIME,FLOOR,DOOR,WINDOW,STREET,GUNSHOT,SUBWAY,
        QUERY,ASCENT,DESCENT,PSST,BEEP,WALKURE,RAZZBERRY,EUROPE) BYT
         DATA(1,2,3,4,5,6,7,8,9,14,14,14,13,14,15,10,12);
DCL AL(18) BYTE DATA(80H,81H,82H,85H,88H,83H,89H,87H,86H,
                     91H,8AH,8BH,8DH,99H,95H,90H,8AH,8DH);
DCL SOUNDCOUNT ADDRESS;
DCL (BLINKCYCLE,ONTIME) ADDRESS DATA(300H,180H);
DCL (BLINKFLAG,BLINKSAVE) BYTE;
DCL BLINKTIME ADDRESS;
DCL STEP(20) ADDRESS;
DCL SPOT ADDRESS AT (.STEP+18);
DCL OLDSPOT ADDRESS;
DCL OLDSP(10) ADDRESS;
DCL (FOUND,LENGTH,CL,CL1,CLH,NSTAY) BYTE;
DCL CH ADDRESS;
DCL OLDCLUE(10) BYTE;
DCL CHOICE(10) ADDRESS;
DCL INFORMATION(4) BYTE;
DCL (QUESTION,BLANK) BYTE DATA(35H,0FFH);
DCL DISPLAY(10) BYTE DATA(3,9FH,25H,0DH,99H,49H,41H,1FH,1,19H);
DCL (BS,BS1,NS,BLDGLAST) ADDRESS;
DCL (BSOUT,X,Y,Z,XOUT,YOUT,BUT,IBUT) BYTE;
DCL SECONDS BYTE DATA(3);
DCL OFFTIME BYTE DATA(0FFH);
DCL DUTY BYTE DATA(0FFH);
DCL SAVED(4) BYTE;
DCL BUTT(5) STRUCTURE(ONS(3) BYTE) DATA(9,0,13,7,8,12,5,6,11,
                                        3,4,10,1,2,16);
DCL (ON,TIP,ARREST,MOVE,NONE,OFF) BYTE DATA(10,11,12,13,15,16);
DCL (LETF,LETD,LETG,LETC,LETS,LETB,LETR,LETL,LETT,CURSOR,HYPHEN)
        BYTE DATA(71H,85H,43H,63H,49H,0C1H,0F5H,0E3H,0E1H,0EFH,0FDH)
DCL STIME(16) ADDRESS DATA(0,60H,30H,28H,20H,38H,16H,25H,
                           48H,60H,10H,40H,60H,15H,4,40H);
SOUNDS: PROCEDURE(S);
        DCL (I,S) BYTE;
        OUTPUT(1),OUTPUT(29H),OUTPUT(21H)=0;
MILLISEC:CALL TIME(10H);
        OUTPUT(21H)=10H;
DELAY:  DO I=0 TO 7;
FIFTHSEC:       CALL TIME(250);
        END;
        SOUNDCOUNT=STIME(S);
        OUTPUT(1)=AL(S);
        OUTPUT(21H)=10H OR S;
END SOUNDS;

LAB: PROCEDURE;
        DCL (I,J,K) BYTE;
        DCL (PORTD,REPORT) BYTE;
        DCL JBOUNCE LIT '5';
        DCL INVBIT(8) BYTE DATA(15,0,1,15,2,15,15,15);
        OUTPUT(29H)=0;
        OUTPUT(2BH)=0FFH;
        LASTBUT=BUT;
        RANDOM=RANDOM+1;
BUTTON: DO IBUT=3 TO 7;
                OUTPUT(2AH)=NBIT(IBUT);
READPORT:       PORTD=INPUT(0) AND 7;
                I=INVBIT(PORTD);
                IF I<>15 THEN
                  DO;   K=0;
UNBOUNCE:               DO J=0 TO JBOUNCE;
```

```
REREAD:                                REPORT=INPUT(0) AND 0FH;
                                       IF REPORT<>PORTD THEN K=1;
                              END;
                              IF K>0 THEN GO TO NIBUT;
                              BUT=BUTT(IBUT-3).ONS(I);
                              GO TO LIGHT;
                        END;
NIBUT:   END;
NOPUSH:  BUT=15;
LIGHT:   IF JLT>3 THEN JLT=0;
         ELSE JLT=JLT+1;
         IF JLT=2 THEN JLT=3;
         IF BLINKFLAG<2 THEN
            DO;  IF BLINKTIME<BLINKCYCLE THEN BLINKTIME=BLINKTIME+1;
                 ELSE BLINKTIME=0;
                 IF ARRESTFLAG>0 THEN IF JLT<>IDIG(ARRESTFLAG) THEN GO TO OUT
                 IF BLINKTIME>ONTIME THEN GO TO DEBOUNCE;
            END;
OUT:     OUTPUT(29H)=0;
         OUTPUT(2AH)=DIGIT(JLT);
         OUTPUT(29H)=BIT(JLT);
DUTYCYCLE:DO I=1 TO DUTY;
                 CALL TIME(0FFH);
           END;
DEBOUNCE: IF LASTBUT<15 THEN IF LASTBUT=BUT THEN
                                       DO;
STILLP:                                    PRESSFLAG=1;
                                           RETURN;
                                       END;
           PRESSFLAG=0;
ENDLAB:
END LAB;


BUILDINGXY: PROCEDURE(SPOT);
         DCL SPOT ADDRESS;
         BS=SPOT/100;
         NS=SPOT-100*BS;
         BSOUT=BS+1;
         IF SPOT=402 THEN NS=0;
         YOUT,Y=NS/10; XOUT,X=NS-10*Y;
         IF CLUE(SPOT)=SUBWAY THEN
           DO;   BSOUT=9;
                 YOUT=0;
                 XOUT=BS;
                 IF SPOT=401 THEN  XOUT=0;
                 RETURN;
           END;
         IF (CLUE(SPOT) AND 0FH)=STREET THEN
           DO;   BSOUT=BSOUT+4;
/*               IF X=0 THEN
                   DO;   IF Y<9 THEN DO; XOUT=Y; YOUT=0; END;
                   END;  */
                 IF Y=0 THEN
                 IF SPOT=402 THEN BSOUT=5;
           END;
END BUILDINGXY;

CLUEOUT: PROCEDURE(CL);
         DCL CL BYTE;
         DIGIT(0)=BLANK;
         DIGIT(3)=DISPLAY(BSOUT);
         IF CL>9 THEN CL=8;
         DO CASE CL;
                 ;;;DO; DIGIT(1)=LETC; DIGIT(0)=LETR; END;
                 DO; DIGIT(1)=LETF; DIGIT(0)=LETL; END;
                 DO; DIGIT(1)=LETD; DIGIT(0)=LETR; END;
                 DO; DIGIT(1)=LETG; DIGIT(0)=LETL; END;
                 DO; DIGIT(1)=LETS; DIGIT(0)=LETT; END;
                 DO; DIGIT(1),DIGIT(0)=HYPHEN; END;
                 DO; DIGIT(1)=LETS; DIGIT(0)=LETT; END;
```

```
        END;
END CLUEOUT;


TIPOFF: PROCEDURE;
        RND(3)=RANDOM;
        IF TIPFLAG=1 THEN
          DO;   CALL BUILDINGXY(SPOT);
                INFORMATION(3)=DISPLAY(BSOUT);
                INFORMATION(1)=DISPLAY(YOUT);
                INFORMATION(0)=DISPLAY(XOUT);
          END;
PPSST:  INFORMATION(2)=BLANK;
        OUTPUT(29H)=0;
        DO I=0 TO 3;
                SAVED(I)=DIGIT(I);
                IF TIPFLAG=1 THEN DIGIT(I)=INFORMATION(I);
        END;
        IF TIPFLAG=2 THEN CALL CLUEOUT(CL);
STILLTIP:CALL LAB;
        CALL TIME(SECONDS);
        IF PRESSFLAG=1 THEN GO TO STILLTIP;
        OUTPUT(29H)=0;
        DO I=0 TO 3;
                DIGIT(I)=SAVED(I);
        END;
        RETURN;
ENDTIP:
END TIPOFF;



SUCCESSIVE: PROCEDURE(S);
        DCL ENOUGH BYTE DATA(11);
        DCL (I,J) BYTE;
        DCL S BYTE;
        OUTPUT(29H)=0;
        CALL SOUNDS(S);
        DO J=1 TO ENOUGH;
          DO I=1 TO STIME(S);
                IF RUNFLAG>0 THEN
                   IF BUT=TIP THEN
                        DO; TIPFLAG=1;
                            CALL TIPOFF;
                        END;
                CALL TIME(22*SECONDS);
          END;
        END;
END SUCCESSIVE;
ARRESTED: PROCEDURE;
        DCL I BYTE;
        DCL ONCYCLES BYTE DATA(60);
/*      DCL OFFCYCLES BYTE DATA(2);
        OUTPUT(29H)=0;
        DO I=0 TO OFFCYCLES;
                CALL TIME(OFFTIME);
        END;   */
        DO I=0 TO ONTIME;
                CALL LAB;
        END;
        ARRESTFLAG=0;
        RND(2)=RANDOM;
        CALL SUCCESSIVE(SIREN);
        CALL BUILDINGXY(SPOT);
        IF ((DIG(3)=BSOUT) AND (DIG(1)=YOUT) AND (DIG(0)=XOUT)) THEN
                DO;     CALL SUCCESSIVE(GUNSHOT);
                        IF LOW(RANDOM)<52 THEN
                           DO;  RUNFLAG=4+(RANDOM AND 3);
                                CALL SUCCESSIVE(NYAH);
                                RETURN;
```

```
                        END;
                    NEXTTHIEFFLAG=2;
                    RUNFLAG=0;
/*                  CALL SUCCESSIVE(WALKURE);                    */
                    CALL SUCCESSIVE(EUROPE);
                END;
        ELSE CALL SUCCESSIVE(RAZZBERRY);
END ARRESTED;

CHOOSE: PROCEDURE(TYPE,EXCLUDE);
        DCL TYPE BYTE;
        DCL (II,JJ) BYTE;
        DCL (EXCLUDE,GT) BYTE;
        FOUND=0;
        GT=2;
        IF (CL1<7) THEN IF ((CL=5) OR (CL=6)) THEN IF ST1>ST THEN GT=0;
                                    ELSE GT=1;
        IF EXCLUDE>3 THEN RETURN;
        DO J=0 TO 5;
                CH=POSSIBLE(ST).DIRECTION(J);
                IF CH=0 THEN GO TO NEXTJ;
                CLH=CLUE(CH) AND MASK;
                DO CASE EXCLUDE;
                        IF CLH=TYPE THEN GO TO ADDCH;
                        IF CLH<>TYPE THEN GO TO ADDCH;
                        IF ((CLH=TYPE) AND ((CLUE(CH) AND 0FH)<7)) THEN
                                        GO TO ADDCH;
                        IF ((CLH=TYPE) AND (CH/100<>BLDGLAST)) THEN GO TO ~~AD~~
                END;                                                    ADDCH;
                GO TO NEXTJ;
ADDCH:          IF CH=ST1 THEN GO TO NEXTJ;
GOTHROUGH:      IF GT<2 THEN
                          DO CASE GT;
                                IF ST<CH THEN GO TO NEXTJ;
                                IF ST>CH THEN GO TO NEXTJ;
                          END;
                CHOICE(FOUND)=CH;
                FOUND=FOUND+1;
NEXTJ:  END;
        IF FOUND=0 THEN RETURN;
        LENGTH=LENGTH+1;
        CH,STEP(LENGTH)=CHOICE(RANDOM MOD FOUND);
        IF TYPE=40H THEN IF EXCLUDE=0 THEN
          DO;
OLDCRIME:       DO II=0 TO NCOMMIT;
                        IF CH=COMMIT(II) THEN GO TO FINDCRIME;
                END;
NEWCRIME:       RETURN;
FINDCRIME:      IF FOUND<2 THEN GO TO CRIMELESS;
                DO JJ=0 TO FOUND-1;
                  DO II=0 TO NCOMMIT;
                        IF CHOICE(JJ)=COMMIT(II) THEN GO TO NEXTJJ;
                  END;
                  CH,STEP(LENGTH)=CHOICE(JJ);
                  RETURN;
NEXTJJ:         END;
CRIMELESS:FOUND=0;
          LENGTH=LENGTH-1;
        END;
END CHOOSE;


INITTH: PROCEDURE;
        DCL (NCLUE,NARR) BYTE;
        OUTPUT(28H)=0FH;
        OUTPUT(3)=0FFH;
        OUTPUT(20H)=0FH;
        OUTPUT(23H)=0;
        OUTPUT(2),OUTPUT(1),OUTPUT(29H),OUTPUT(21H)=0;
        JLT=-1;
```

```
        NEXTFLAG=0;
        LASTBUT=15;
        SPOT=23;
        BLINKFLAG=0;
        OUTPUT(21H)=0;
        IF FIRSTTHIEF=0 THEN    GO TO TURNON1;
/*        DO;
WAIT:           CALL LAB;
                IF BUT<>MOVE THEN GO TO WAIT;
                GO TO TURNON1;
          END;  */
TURNOFF:NCLUE=3;
        NARR=0;
        TIPFLAG=1;
        DO I=0 TO 3;
                DIGIT(I)=BLANK;
        END;
OFFLAB: CALL LAB;
        IF BUT<>ON THEN GO TO OFFLAB;
DISPLAYMODE:CALL SUCCESSIVE(ASCENT);
HYPHENS:DO I=0 TO 3;
                DIGIT(I)=HYPHEN;
        END;
        DIGIT(2)=BLANK;
CLAB:   CALL LAB;
        IF BUT=15 THEN GO TO CLAB;
        IF BUT<10 THEN DO; CALL SUCCESSIVE(BEEP); GO TO CLAB; END;
        IF BUT=OFF THEN GO TO TURNOFF;
        IF BUT=ON THEN GO TO TURNON;
CLBUT:  IF BUT<>MOVE THEN GO TO ARRBUT;
        CL=NCLUE;
        CALL SUCCESSIVE(NCLUE);
        BSOUT=1;
        IF NCLUE=9 THEN DO;     CALL SUCCESSIVE(STREET);
                                CL=7;
                        END;
        ELSE CALL CLUEOUT(CL);
        IF NCLUE<7 THEN NCLUE=NCLUE+1;
        ELSE IF NCLUE=7 THEN NCLUE=9;
             ELSE NCLUE=3;
        GO TO CLAB;
ARRBUT: IF BUT<>ARREST THEN GO TO TPBUT;
        CALL SUCCESSIVE(SIREN);
        DO CASE NARR;
          DO;   CALL SUCCESSIVE(GUNSHOT);
/*              CALL SUCCESSIVE(WALKURE);       */
                CALL SUCCESSIVE(EUROPE);
          END;
          CALL SUCCESSIVE(RAZZBERRY);
          DO;   CALL SUCCESSIVE(GUNSHOT);
                CALL SUCCESSIVE(NYAH);
          END;
        END;
        IF NARR<2 THEN NARR=NARR+1;
        ELSE NARR=0;
        GO TO CLAB;
TPBUT:  IF BUT<>TIP THEN GO TO CLAB;
        CALL SUCCESSIVE(PSST);
        CALL TIPOFF;
        GO TO CLAB;
TURNON:
TURNON1:ARRESTFLAG,TIPFLAG,RUNFLAG=0;
        RND(1)=RANDOM;
END INITTH;
```

```
MOVETHIEF: PROCEDURE;
        DCL (I,J) BYTE;
        IF NEXTTHIEFFLAG>0 THEN GO TO ADDSTEP;
        CL1=CLUE(SPOT) AND 0FH;
        DO I=0 TO LENGTH;
                STEP(I)=STEP(I+1);
/*              OLDCLUE(I)=OLDCLUE(I+1);        */
        END;
        LENGTH=LENGTH-1;
        CL=CLUE(SPOT);
        IF SPOT=209 THEN
          DO;   IF COMMIT(0)>0 THEN GO TO SEECLUE;
                COMMIT(0)=209;
                CL=3;
          END;
        IF CL=44H THEN
          DO;
            DO J=0 TO NCOMMIT;
                IF SPOT=COMMIT(J) THEN GO TO SEECLUE;
            END;
NEWCR:          NCOMMIT=NCOMMIT+1;
                COMMIT(NCOMMIT)=SPOT;
COMMITTED:      CL=3;
          END;
SEECLUE:CL=CL AND 0FH;
        CALL BUILDINGXY(SPOT);
        IF CL1=9 THEN IF CL=9 THEN GO TO ADDSTEP;
                      ELSE DO;  OLDSP(9)=SPOT;
                                GO TO SOUNDCLUE;
                           END;
        DO I=0 TO 8;
                OLDSP(I)=OLDSP(I+1);
                OLDCLUE(I)=OLDCLUE(I+1);
        END;
        OLDCLUE(9)=CL;
        OLDSP(9)=SPOT;
/*IF ((CL<>STREET) AND (CL1=STREET)) THEN
                        CALL SUCCESSIVE(STREET);
          ELSE IF ((CL<7) AND (CL<>FLOOR)) THEN CALL SUCCESSIVE(FLOOR); */
SOUNDCLUE:IF CL<9 THEN CALL CLUEOUT(CL);
         CALL SUCCESSIVE(CL);
ADDSTEP: ST=STEP(LENGTH);
         ST1=STEP(LENGTH-1);
         CALL BUILDINGXY(ST1);
         BS1=BS;
         CALL BUILDINGXY(ST);
         CL=CLUE(ST) AND 0FH;
         CL1=CLUE(ST1) AND 0FH;
NOTCRIME:IF CL>6 THEN IF CL1<7 THEN
                DO;     BLDGLAST=BS1;
                        CRIMEFLAG=0;
                        NCOMMIT=0;
                END;
        IF CL<>SUBWAY THEN GO TO MAGNET;
ATSUBWAY: IF CL1=SUBWAY THEN GO TO ANYWHERE;
SUBCHOICE:MASK=0FFH;
        CALL CHOOSE(SUBWAY,0);
        RETURN;
MAGNET: MASK=40H;
        CALL CHOOSE(40H,0);
        IF FOUND>0 THEN
          DO;   IF CH<>209 THEN CRIMEFLAG=CRIMEFLAG+1;
                RETURN;
          END;
MAGNETS:IF CL<7 THEN GO TO INSIDE;
        IF ST=402 THEN
           IF (RANDOM AND 3)>0 THEN
                GO TO OUTDOORS;
        MASK=0FFH;
        CALL CHOOSE(SUBWAY,0);
        IF FOUND>0 THEN RETURN;
```

```
OUTDOORS: DO I=(LENGTH-3) TO (LENGTH);
                Z=CLUE(STEP(I));
                IF Z<>STREET THEN IF Z<>SUBWAY THEN GO TO STAYOUT;
          END;
GOIN:    MASK=80H;
         CALL CHOOSE(80H,3);
         IF FOUND=0 THEN GO TO STAYOUT;
/*       Z=CH/100;
         IF BS<>Z THEN
                  DO;    STEP(LENGTH),ST=ST+(Z-BS)*100;
                         BS=Z;
                  END;    */
         RETURN;
 RETURN;
STAYOUT: MASK=080H;
         IF (RANDOM AND 15)<3 THEN CALL CHOOSE(80H,3);
         IF FOUND>0 THEN RETURN;
         MASK=0FH;
         CALL CHOOSE(STREET,3);
         IF FOUND>0 THEN RETURN;
         CALL CHOOSE(STREET,0);
         IF FOUND>0 THEN RETURN;
         ELSE GO TO ANYWHERE;
INSIDE: MASK=80H; FOUND=0;
INTERIOR:IF CRIMEFLAG=0 THEN CALL CHOOSE(0,2);
          ELSE
EXTERIOR:IF (CLUE(ST) AND 80H)>0 THEN DO;MASK=0FH;
                                          CL=CLUE(ST);
                                          CALL CHOOSE(STREET,0);
                                          CL=CL AND 0FH;
                                        END;
          ELSE IF CRIMEFLAG>1 THEN CALL CHOOSE(80H,0);
          IF FOUND>0 THEN GO TO RTN;
ANYWHERE:MASK=0FFH;
         CALL CHOOSE(SUBWAY,1);
RTN:
END MOVETHIEF;

ADDSTEPS: PROCEDURE;
         DCL (I,J) BYTE;
         IF LENGTH >9 THEN RETURN;
         CALL MOVETHIEF;
END ADDSTEPS;


NEXTTHIEF: PROCEDURE;
         DCL I BYTE;
         DCL J BYTE;
         OUTPUT(29H)=0;
         NEXTTHIEFFLAG=1;
         DO I=0 TO LASTSTEP;
                STEP(I)=0;
                OLDCLUE(I)=BEEP;
         END;
         DO I=0 TO 2;
                INFORMATION(I)=HYPHEN;
                DIGIT(I)=HYPHEN;
         END;
         NCOMMIT=1;
         COMMIT(0)=0;
         DIGIT(2)=BLANK;
         J=-1;
         NS=RANDOM MOD 18;
SPOTTED: SPOT=CRIMELOC(NS);
         COMMIT(1)=SPOT;
         OLDCLUE(9)=CRIME;
         LENGTH=9;
         CRIMEFLAG=1;
END NEXTTHIEF;
```

```
/* MAIN PROGRAM */
STOPTHIEF:
STARTTHIEF: FIRSTTHIEF=1;
NEXTTH: CALL INITTH;
        CALL NEXTTHIEF;
        NEWBUT=MOVE;
THLOOP: CALL LAB;
        IF NEXTTHIEFFLAG=1 THEN GO TO FIRSTSTEPS;
        IF BUT=15 THEN GO TO THLOOP;
        IF PRESSFLAG=1 THEN GO TO THLOOP;
OFFBUT: IF BUT=OFF THEN GO TO STARTTHIEF;
        IF NEXTTHIEFFLAG=2 THEN IF BUT=ON THEN GO TO NEXTTH;
                                ELSE IF BUT<10 THEN GO TO OLDCLUES;
                                     ELSE GO TO THLOOP;
FIRSTSTEPS:IF NEXTTHIEFFLAG=1 THEN DO; OUTPUT(29H)=0;
                                   RND(0)=RANDOM;
                                   CALL ADDSTEPS;
                                   NEXTTHIEFFLAG=0;
                                   FIRSTTHIEF=0;
                                   DIGIT(0)=LETR;
                                   DIGIT(1)=LETC;
                                   CALL BUILDINGXY(SPOT);
                                   DIGIT(3)=DISPLAY(BSOUT);
                                   CALL SUCCESSIVE(CRIME);
                                   GO TO THLOOP;
                                END;
        IF ARRESTFLAG>0 THEN
                DO;     IF BUT>9 THEN
                          DO;
                                 BLINKFLAG=0;
                                 CALL CLUEOUT(OLDCLUE(9));
                                 ARRESTFLAG=0;
                                 IF BUT=ARREST THEN
                                        DO;     CALL SUCCESSIVE(BEEP);
                                                CALL BUILDINGXY(SPOT);
                                                GO TO THLOOP;
                                        END;
                           END;
                END;
        ELSE IF BUT>9 THEN BLINKFLAG=0;
             ELSE GO TO OLDCLUES;
MOVEBUT:IF BUT= MOVE THEN
          DO;   RND(1)=RANDOM;
                OUTPUT(29H)=0;
                IF (((CLUE(SPOT) AND 0FH)>6) OR
                         (NSTAY>2) OR ((RANDOM AND 4)=0)) THEN
                         DO;
MOVING:                         CALL MOVETHIEF;
                                IF BSOUT=9 THEN GO TO MOVING;
                                NSTAY=0;
                         END;
                ELSE DO;        BLINKFLAG=1;
                                CALL SUCCESSIVE(BEEP);
                                NSTAY=NSTAY+1;
                           END;
ENDMV:          GO TO THLOOP;
          END;
ONBUT:  IF BUT=ON THEN GO TO THLOOP;
ARRESTBUT:IF BUT=ARREST THEN DO;
                                ARRESTFLAG=1;
                                DO I=0 TO 3;
                                        DIGIT(I)=CURSOR;
                                END;
                                BLINKFLAG=1;
                                CALL SUCCESSIVE(ASCENT);
                                GO TO THLOOP;
                            END;
TIPBUT: IF BUT=TIP THEN DO;
                         CALL SUCCESSIVE(PSST);
                         TIPFLAG=1;
                         CALL TIPOFF;
                         GO TO THLOOP;
                       END;
```

a loudspeaker;

means interconnecting said microcomputer and said loudspeaker for energizing said speaker to generate sounds corresponding to waveforms generated by said processor;

a keyboard comprising numeric data entry keys and control keys;

means interconnecting said microcomputer and said keyboard for enabling said microcomputer to sense and respond to operations of said keyboard;

incorporated in said read only memory, a repertory of programs for generating sounds characterizing a plurality of different types of locations on said field including sounds simulating:

footsteps on a floor, an opening door, an alarm, and breaking glass, said repertory including also programs for generating sounds characterizing a successful location of the thief and an unsuccessful location;

incorporated in said read only memory, a representation of possible thief locations and a directory of possible moves from that location consistent with the indicia on said board, said representation thereby providing rules for movement of the thief;

also incorporated in said read only memory, a move program which includes a random number generator and which is initiated by operation of a first control key for altering the value representing the location of the thief, the alteration being predicated on a value provided by said random number generator so as to be unpredictable though in conformance with said rules, and for initiating that one of the repertory of sound generating programs which generates a sound characteristic of the new value and corresponding location on the board; and also incorporated in said read only memory, a capture program which is initiated by operation of a second one of said control keys for comparing a value entered by a player through said numeric keyboard with the current value representing the location of the thief and for initiating that one of the repertory of sound generating programs which indicates successful or unsuccessful locations, respectively, depending upon a match or mismatch of the compared values.

5. Game apparatus as set forth in claim 4 further comprising tokens for representing respective players to be moved around the board in pursuit of the thief and dices for determining the distance a player may move his piece along the board.

6. Game apparatus as set forth in claim 4 further comprising a display interconnected with and driven by said microcomputer, said repertory of sound generating programs being operative also to energize said display to generate visible clues corresponding to the sound clues.

7. Game apparatus as set forth in claim 6 wherein said read only memory also incorporates a program, initiated by operation of a third control key, for energizing said display to represent the current stored value characterizing the location of the thief.

* * * * *